US009957754B2

(12) United States Patent
Osadchuk et al.

(10) Patent No.: US 9,957,754 B2
(45) Date of Patent: May 1, 2018

(54) SYSTEMS AND METHODS OF OPERATING DIRECTIONAL DRILLING RIGS

(71) Applicant: OZZIE ENTERPRISES LLC, Scottsdale, AZ (US)

(72) Inventors: Dwayne Osadchuk, Scottsdale, AZ (US); Ryan Littlefield, Scottsdale, AZ (US)

(73) Assignee: Ozzie Enterprises LLC, Scottsdale, AZ (US)

( * ) Notice: Subject to any disclaimer, the term of this patent is extended or adjusted under 35 U.S.C. 154(b) by 0 days. days.

(21) Appl. No.: 15/365,009

(22) Filed: Nov. 30, 2016

(65) Prior Publication Data

US 2017/0234070 A1 Aug. 17, 2017

Related U.S. Application Data

(60) Provisional application No. 62/294,685, filed on Feb. 12, 2016.

(51) Int. Cl.

| | |
|---|---|
| ***E21B 7/04*** | (2006.01) |
| ***E21B 47/09*** | (2012.01) |
| ***E21B 47/12*** | (2012.01) |
| ***E21B 44/00*** | (2006.01) |
| ***E21B 47/022*** | (2012.01) |

(52) U.S. Cl.

CPC ..... *E21B 7/04* (2013.01); *E21B 44/00* (2013.01); *E21B 47/02224* (2013.01); *E21B 47/09* (2013.01); *E21B 47/122* (2013.01)

(58) Field of Classification Search

CPC ..... E21B 7/046; E21B 7/04

USPC ..... 175/62

See application file for complete search history.

(56) References Cited

U.S. PATENT DOCUMENTS

| | | | | |
|---|---|---|---|---|
| 7,684,929 | B2 * | 3/2010 | Prange | |
| 8,794,353 | B2 * | 8/2014 | Benson | |
| 2008/0034065 | A1 | 2/2008 | Redford et al. | |
| 2008/0314641 | A1 * | 12/2008 | McClard | |
| 2011/0272144 | A1 | 11/2011 | Belcher et al. | |
| 2011/0297395 | A1 | 12/2011 | Codesal et al. | |
| 2012/0316785 | A1 | 12/2012 | Liu et al. | |
| 2013/0228374 | A1 | 9/2013 | Chapman | |
| 2014/0297343 | A1 | 10/2014 | Tucker et al. | |
| 2014/0379133 | A1 * | 12/2014 | Toma | E21B 44/00 700/275 |
| 2015/0053483 | A1 | 2/2015 | Mebane, III | |
| 2015/0138918 | A1 | 5/2015 | Jurok et al. | |

OTHER PUBLICATIONS

PCT International Search Report and Written Opinion, corresponding to PCT Application No. PCT/US2016/064407, dated Feb. 16, 2017, 17 pages.

* cited by examiner

*Primary Examiner* — Kenneth L Thompson
(74) *Attorney, Agent, or Firm* — Fennemore Craig, P.C.

(57) ABSTRACT

A method of operating a directional drill rig from a remote location may involve the steps of: Issuing instructions from a remote location using a remote communications system; receiving said instructions at a drill site location using an on-site communications system; applying said instructions to a directional drill rig; and communicating directional drill rig data from the drill site location to the remote location using the remote and on-site communications systems.

7 Claims, 3 Drawing Sheets

SYSTEMS AND METHODS OF OPERATING DIRECTIONAL DRILLING RIGS

CROSS-REFERENCE TO RELATED APPLICATION

This application claims the benefit of U.S. Provisional Patent Application No. 62/294,685, filed on Feb. 12, 2016, which is hereby incorporated herein by reference for all that it discloses.

TECHNICAL FIELD

The present invention relates to systems and methods of performing directional drilling in general and more particularly to systems and methods of operating a plurality of directional drilling rigs in conjunction with on-site and remote assets.

BACKGROUND

The practice of drilling wells or boreholes with a directional drilling machine or rig requires accurate geological surveys and information, precise engineering, careful management of equipment, and the continued monitoring of the inclination and azimuth of the downhole bore to ensure it follows the desired path. Technicians possessing the requisite skills must travel to the directional drilling rig at the drilling site location and closely supervise its activity. These drill sites may be in highly remote or inhospitable locations, with significant associated travel costs and delays. Furthermore, the presence of a technician at one remote location limits the ability of the technician to monitor the activity of directional drilling rigs at other locations. Methods and systems to improve the supervision of directional drilling rigs and the accuracy with which they operate, while continually optimizing personnel resource management and reducing travel costs to a minimum, are constantly being sought.

SUMMARY OF THE INVENTION

One embodiment of a method of operating a plurality of directional drilling rigs at different locations may involve the steps of: Collecting, at a first location, preliminary site data relating to at least a first drilling job to be performed by a first directional drilling rig at the first location; collecting, at a second location, preliminary site data relating to a second drilling job to be performed by a second directional drilling rig at the second location; transferring to a single off-site system navigator the preliminary site data for at least one of the first and second drilling jobs; preparing at least one of the first and second directional drilling rigs for the respective first and second drilling jobs; loading data relating to at least one of the first and second drilling jobs into a navigation system operatively associated with the first and second directional drilling rigs; commencing at least one of the first and second drilling jobs; transferring steering patterns from the off-site system navigator to an on-site drilling operator for the commenced drilling job; and operating the directional drilling rig for the commenced drilling job in accordance with the transferred steering patterns.

Another method of operating a directional drill rig from a remote location may involve the steps of: Issuing instructions from a remote location using a remote communications system; receiving said instructions at a drill site location using an on-site communications system; applying said instructions to a directional drill rig; and communicating directional drill rig data from the drill site location to the remote location using the remote and on-site communications systems.

Also disclosed is a system of operating a directional drill rig from a remote location that includes a remote communications system provided at a remote location and an on-site communications system provided at a drill site location that is operatively connected to the remote communications system. A directional drill rig provided at a drill site location is operatively connected to the on-site communications system and responds to communications provided from the remote communications system so that at least certain portions of the operation of the drill rig may be controlled from the remote location.

BRIEF DESCRIPTION OF THE DRAWINGS

Illustrative and presently preferred exemplary embodiments of the invention are shown in the drawings in which.

DETAILED DESCRIPTION OF THE PREFERRED EMBODIMENTS

Figure 1:
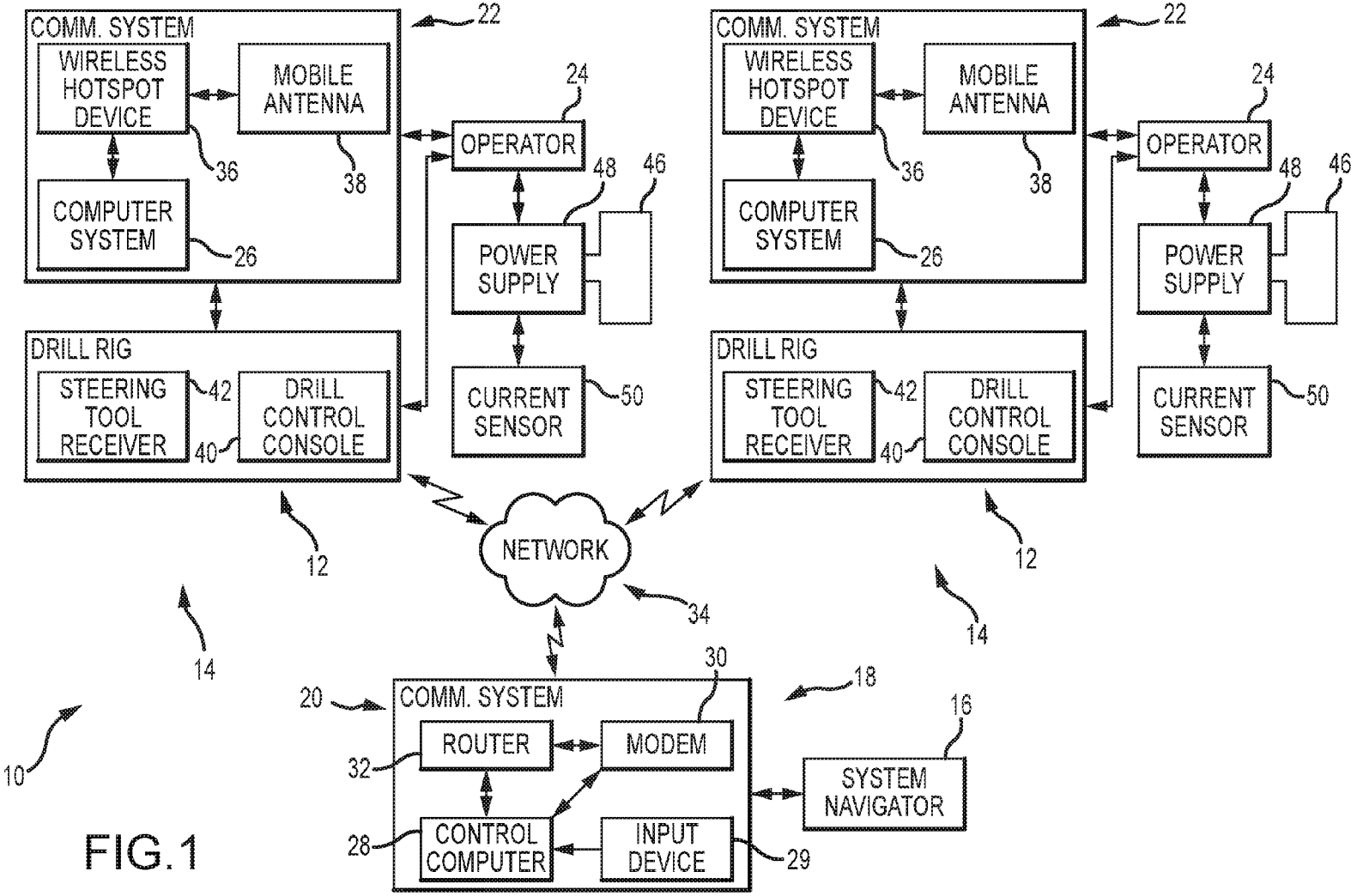
FIG. 1 is a schematic representation of one embodiment of a system of operating a plurality of directional drilling rigs according to the present invention.

One embodiment of a system 10 for operating a plurality of directional drilling rigs is shown in FIG. 1 as it could be used to operate or control one or more directional drilling rigs 12 located at one or more drill sites or locations 14. In the particular embodiments shown and described herein, the system 10 may be used to allow a single navigation technician or system navigator 16 to control at least certain portions of the operation (e.g., typically steering or navigation) of at least one, and generally a plurality, of directional drilling rigs 12 located at the various locations or drill sites 14. Further, the system navigator 16 may exercise such control from a single location 18 that is located remotely from the various drill sites or locations 14.

In one embodiment, the system navigator 16 may utilize a remote communications system 20 to send information or instructions to the directional drilling rigs 12 located at the various drill site locations 14. An on-site communications system 22 at the drill site location 14 may receive information or instructions from the remote communications system 20. That information and/or instructions may be used to control at least certain aspects of the operation of directional drilling rigs 12 located at the various drill site locations 14. In addition, certain information and/or instructions may be displayed to an on-site directional drill rig operator 24 (e.g., via on-site computer system 26). Thereafter, the on-site directional drill rig operator 24 may operate certain aspects or function of the directional drilling rig 12.

In some embodiments, the on-site communications system 22 may continuously send or communicate data regarding the current position, status, and operation of each directional drill rig 12 to the navigation technician or system navigator 16 at the remote location 18. The system navigator 16 may use this real-time information to alter the drilling paths of the directional drill rigs 12 at the various drill site locations 14. In addition, the system navigator may communicate with the on-site drill rig operator 24 to convey additional instructions and/or authorizations to take certain actions, as will be described in further detail herein.

A significant advantage of the system and methods of the present invention is the efficiency and logistical flexibility they offer. Previously, each on-site drill rig operator 24 needed to possess the navigational skills and training of a navigation technician. The teachings of the present invention permit a single system navigator 16 in a remote location 18 to provide this complex skillset to multiple drill site locations 14, thereby dispensing with the need to ensure that the on-site drill rig operator 24 possesses the required navigational skills. Furthermore, the present invention reduces the number of personnel who must be present on-site at a particular drill site location 14, leading to transportation and logistical savings. Finally, the flexibility of the system and methods of the present invention permit a single system navigator 16 to 'move' from drill site to drill site nearly instantaneously, thereby permitting a single system navigator 16 to simultaneously control a plurality of drilling rigs 12 performing a plurality of drilling jobs across the world.

Having briefly described the system 10 of operating one or more directional drill rigs from a remote location, various exemplary embodiments of the invention will now be described in detail.

Referring back now to FIG. 1, and as briefly described above, one embodiment of the system 10 of operating one or more directional drilling rigs 12 from a remote location 18 may comprise the remote location 18 and one or more drill site locations 14. The directional drilling rig(s) 12 present at the drill site location(s) 14 may comprise any type of drilling machine as would be known in the art or as might be developed in the future that is capable of drilling a steerable drill string into the earth, controlling and modifying the path of the drill string as it drills deeper into the earth, and tracking the location of the drill head underground in order to ensure it remains on course. By way of non-limiting example, a wide variety of directional drilling rigs suitable for use with the present invention are commercially available from Ditch Witch Corporation of Perry, Okla. (US) and Vermeer Corporation of Pella, Iowa (US). The drill site locations 14 may be anywhere in the world, connected by the communications systems 20 and 22 described below. The navigation technician or system navigator 16 at the remote location 18 may utilize the remote communications system 20 to send information or instructions to the various drill site locations 14.

In one embodiment, the remote communications system 20 may comprise a control computer 28 that is connected to a modem 30 and router 32 of the types commonly known in the art. The modem 30 and router 32 may enable the control computer 28 to send and receive information via a network 34. Network 34 may comprise the Internet, a private network or VPN, or other network now known in the art or that may be developed in the future as would be suitable for permitting communications between the remote and on-site communications systems 20 and 22. The control computer 28 may comprise a computer device capable of running software, saving information for later retrieval, receiving input from a user, and sending and receiving electronic information over a network. By way of example, such a control computer 28 might comprise a desktop computer, portable laptop computer, tablet, smartphone, or a similar personal electronic device. The control computer 28 may be preloaded with directional drilling navigation software as would be familiar in the art, a Microsoft Office suite, or specialized remote control software. In an embodiment, the control computer 28 may utilize router 32 to communicate with the modem 30 and the network 34; alternatively, the control computer 28 may communicate directly with the modem 30 to reach the network 34.

The navigation technician or system navigator 16 at the remote location 18 may input commands to the control computer 28, which may send the commands using the modem 30 and router 32 to the network 34, and then on to the drill site locations 14. To input these commands into the control computer 28, the navigation technician or system navigator 16 may utilize an input device 29, such as a keyboard and mouse, a touchscreen, or a joystick. Each drill site location 14 may contain an on-site communications system 22 to receive commands from the remote location 18.

In one embodiment, the on-site communications system 22 may comprise a wireless hotspot device 36, which receives the commands from the remote communications system 20 over the network 34 and sends them to the on-site computer system 26. The on-site computer system 26 may comprise a computer device capable of running software, saving information for later retrieval, receiving input from a user, and sending and receiving electronic information over a network. By way of example, such an on-site computer 26 might comprise a desktop computer, portable laptop computer, tablet, smartphone, or a similar personal electronic device. In addition, either the control computer 28 or the on-site computer 26, or both, may record and save all conversations between the system navigator 16 and on-site drill rig operator(s) 24, and may record a complete list of instructions or commands that are sent between the computers using the remote communications system 20 and the on-site communications system 22. The wireless hotspot device 36 may be a cellular telephone or a stand-alone hotspot device of the type well known in the communications industry that can permit access to a network. In an embodiment, the wireless hotspot device of the on-site communications system 22 may be operatively connected to a mobile antenna 38, which may be mounted to directional drilling rig 12. Alternatively, antenna 38 may be provided elsewhere at the drill site location 14 and may extend above the local tree line so as to maximize the signal.

When the on-site communications system 22 receives instructions or information from the remote communications system 20, the on-site computer 26 may display the information to the drill rig operator 24. The drill rig operator 24 may act on this information directly, and may use a drill control console 40 to manipulate the behavior of one or more directional drilling rigs 12 present at the drill site location 14. In the particular embodiment shown and described herein, the on-site computer 26 is operatively connected to a steering tool receiver 42, which may be operatively connected to directional drilling rig 12 at the drill site location 14. This arrangement permits the system navigator 16 to issue steering commands to the on-site computer 26 using the control computer 28, the remote communications system 20, and the on-site communications system 22. Thereafter, the on-site drill rig operator 24 may operate the directional drilling rig 12 in accordance with the issued steering commands. In an alternative embodiment, the system navigator 16 may use the control computer 28, remote communications system 20, and on-site communications system to issue steering commands directly to the steering tool receiver 42. Steering tool receiver 42 may then implement the steering instructions while the on-site drill rig operator 24 supervises the drilling rig 12 activity.

The on-site communications system 22 may send to the remote communications system 20 and control computer 28 real-time telemetry and activity data regarding the directional drilling rigs 12 present at the drill site 14. This will permit the navigation technician or system navigator 16 at the remote location 18 to monitor the activities of the directional drill rigs 12. This information may be continuously updated in real time, or may be updated at specifically defined time intervals, such as every minute, every five minutes, every thirty minutes, or any other interval of time. This flow of information may permit the system navigator 16 to adapt to changing conditions at the drill site location 14 and redirect the activities of the directional drill rigs 12 accordingly. The flow of information also may allow the on-site drill rig operator 24 to continuously monitor the decisions of the system navigator 16 and provide feedback relating to on-site conditions or issues.

Figure 2:
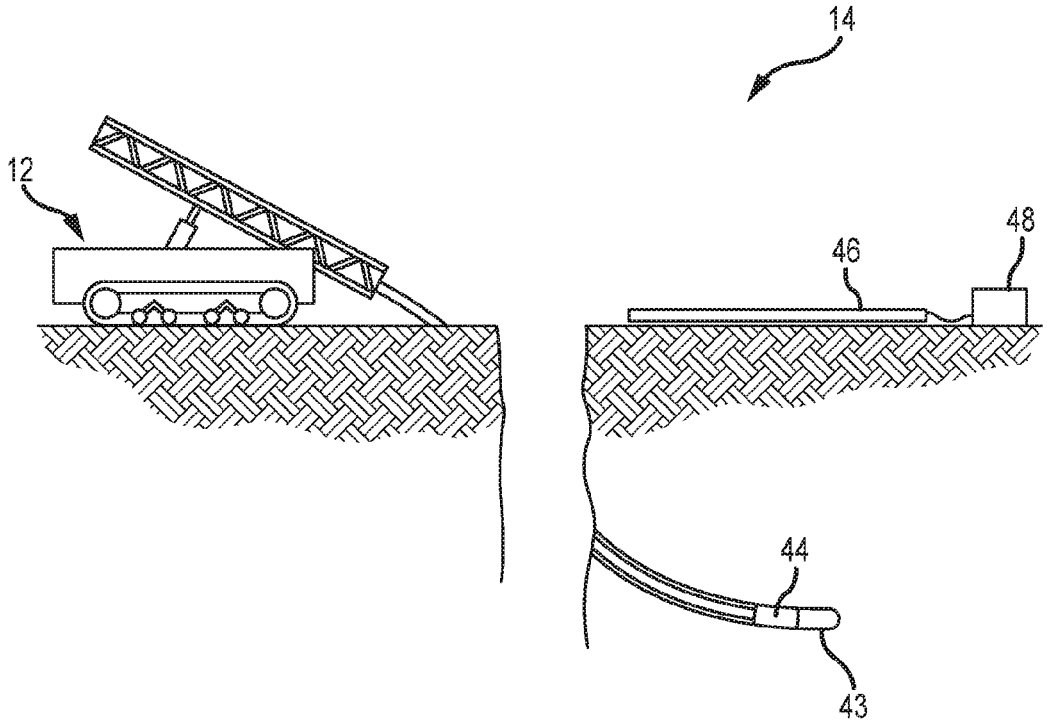
FIG. 2 is a schematic representation of an exemplary drill site location showing an arrangement of a drilling rig, borehole, downhole probe, and above-ground coil.

Referring now primarily to FIG. 2, the information shared between the remote communication system 20 and on-site communications system 22 may permit the system navigator 16 and on-site drill rig operator 24 to coordinate their actions and perform complex drilling tasks. These tasks may include the taking of a survey shot, which may determine or verify the location of the borehole 43 by means of a below-ground downhole probe 44 and an above-ground coil 46. Coil 46 may be operatively connected to a suitable power supply 48 and current sensor 50. As is known in the art, an electric current flowing in coil 46 is detected by the downhole probe 44, thereby allowing the position of the downhole probe 44 to be determined. In one embodiment, the power supply 48 may comprise an electric welding system, such as any of a wide range of welding systems commercially available from Miller Electric Manufacturing Company of Appleton, Wis. (US). Current sensor 50 may comprise any of a wide variety of ammeters and/or electrical multimeters commercially available from Fluke, Incorporated, of Everett, Wash. (US).

Figure 3:
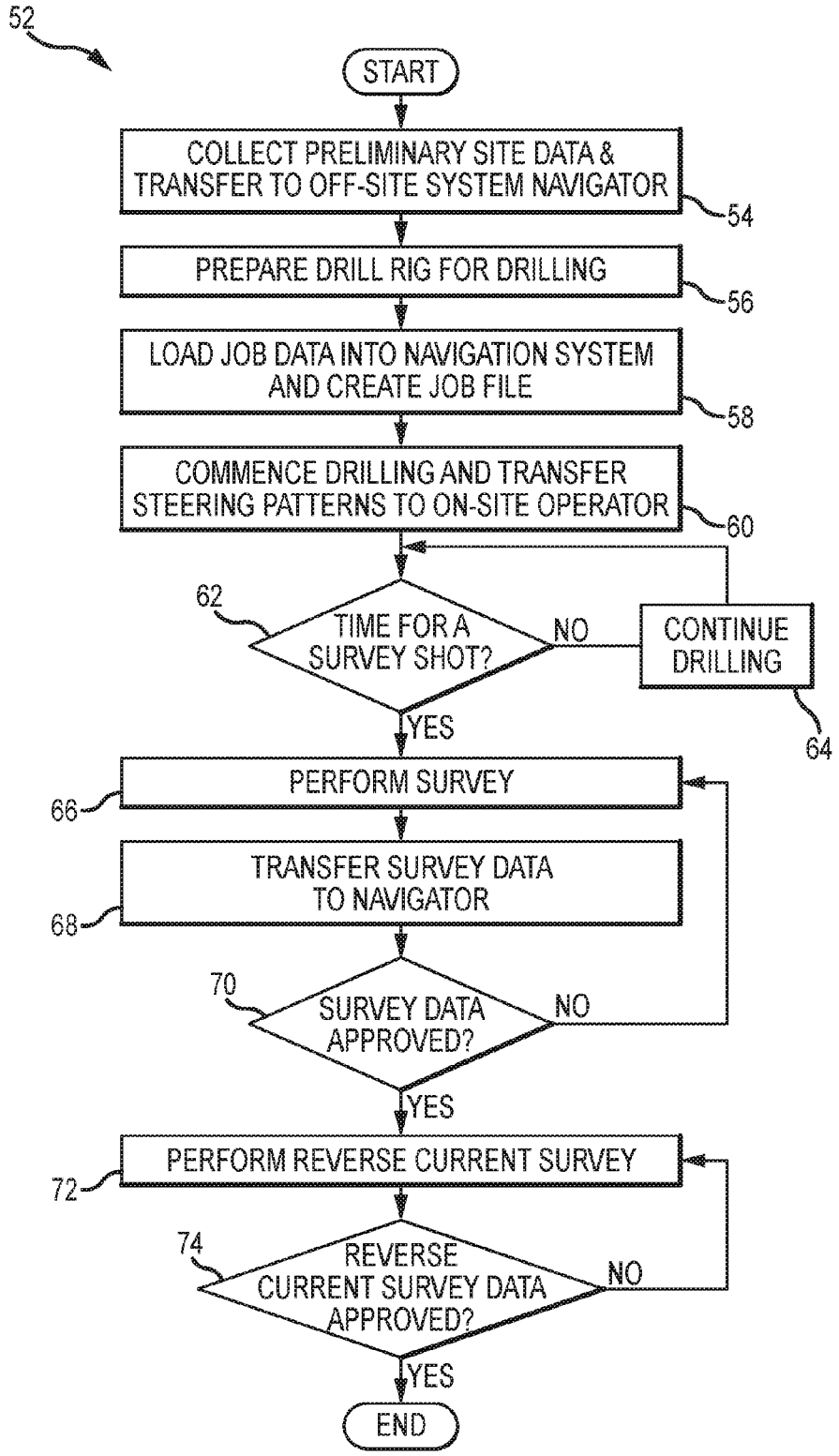
FIG. 3 depicts a flow chart of one embodiment of a method of operating a plurality of directional drilling rigs according to the present invention.

With reference now primarily to FIG. 3, but with occasional reference to FIGS. 1 and 2, the system 10 may be configured to operate in accordance with a method 52. A first step 54 of method 52 may involve the collection of preliminary site data and the transfer of that preliminary site data to the system navigator 16. Preliminary site data include, but are not limited to data relating to topography of the drill site 14, land features, centerlines, fault lines, GPS coordinates, the location and composition of known or potential underground obstructions, and the locations of coils 46. The on-site drill rig operator 24 may collect this preliminary site data and may transfer it to the system navigator 16 via the on-site communications system 22 and remote communications system 20. In an alternative embodiment, a separate survey technician present at the drill site 14 may collect the preliminary site data and transfer it to the system navigator via the on-site communications system 22 and remote communications system 20.

The on-site drill rig operator 24 may prepare the drilling rig 12 for drilling (e.g., performing a drilling job) at step 56. In an alternative embodiment, the system navigator 16 may send preparation instructions directly to the drilling rig 12 using the remote and on-site communications systems 20, 22. Depending on the number of drilling jobs that are to be performed as well as the number of drilling rigs 12 that are scheduled to perform the jobs, steps 54 and 56 alternatively may be performed by various on-site drill rig crews at the various drill sites 14.

A next step 58 of method 52 involves the loading of data relating to the various drilling jobs into the navigation system and the creation of respective job files for the drilling jobs. The navigation system may comprise suitable directional drilling rig operation software that is provided on the on-site computer 26. Optionally, the drill rig operation software may also be provided on control computer 28 at remote location 18. The drilling operation may be commenced at step 60, in which various steering commands or drilling patterns (for example) may be transferred or otherwise conveyed to the on-site drill rig operator 24. As discussed herein, the various steering patterns may be developed by the system navigator 16 at the remote location 18. The steering commands or patterns are used by the on-site drill rig operator 24 to operate the drilling rig 12. Of course, the on-site drill rig operator 24 may modify or otherwise alter the steering commands or patterns as the drill rig operator 24 is actually on the drill rig site 14 and maintains full control over the drilling rig 12.

Depending on the nature of the drilling job, it may be desirable (or even required) to perform survey shots from time-to-time. Such survey shots may be used to track and/or update the location of the borehole 43 formed by the drilling rig 12 to ensure proper navigation. Normally, the need for a survey shot will be determined by the system navigator 16. If the system navigator 16 determines that no survey shot is required (e.g., at step 62), then the drilling operation may proceed or continue (e.g., at step 64). Alternatively, if the system navigator 16 determines that a survey shot should be performed, then he or she may provide suitable instructions to the on-site drill rig operator 24 via communications systems 20 and 22. Thereafter, the on-site drill rig operator 24 may perform the survey shot (at step 66). In one embodiment, the survey shot involves the use of the downhole probe 44, coil 46, power supply 48 and current sensor 50 to determine the location of the downhole probe 44.

After the survey shot is performed, the survey shot data may be transferred or otherwise conveyed to the system navigator 16 at step 68. In one embodiment, the actual survey shot data is not per-se transferred, but is viewed by the drill rig operator 24 on the control computer 28 interfacing with the on-site computer 26; the drill rig operator 24 may then communicate the data to the system navigator 16. The system navigator 16 may review the survey shot data in view of various information, specifications, and parameters that may be associated with or relevant to the particular drilling job being performed. If the survey data are not approved at step 70, e.g., because they are deficient in some regard, then the system navigator 16 may so inform the on-site drill rig operator 24. Thereafter, the on-site drill rig operator 24 may perform another survey shot (e.g., by repeating step 66).

Alternatively, if the system navigator 16 approves the survey shot data, he or she may then instruct the on-site drill rig operator 24 to perform a reverse current survey shot at step 72, as both forward and reverse current surveys are required to complete the location process. The system navigator 16 may then review the reverse current survey data. If the reverse current data are acceptable, as determined during step 74, then the system navigator 16 may so inform the on-site drill rig operator 24 and the process 52 ends. Alternatively, if the reverse current survey data are not acceptable, then the system navigator 16 may instruct the on-site drill rig operator 24 to again perform the reverse current survey shot.

The system navigator 16 may use the remote communications system 20 to rapidly switch between multiple drill site locations 14 throughout the world, each of which may contain one or multiple directional drilling rigs 12, and continuously issue commands to the on-site drill rig operators 24 at each drill site location 14. The on-site communications systems 22 present at each of the separate drill site locations 14 may continually keep the system navigator 16 informed of the activities of the directional drilling rigs 12 at the separate drill site locations 14.

Having herein set forth preferred embodiments of the present invention, it is anticipated that suitable modifications can be made thereto which will nonetheless remain within the scope of the invention. The invention shall therefore only be construed in accordance with the following claims:

The invention claimed is:

1. A method of operating a plurality of directional drilling rigs at different locations under the supervision of a single off-site system navigator, comprising:

activating, at the location of the off-site system navigator, a communications system that connects the off-site system navigator to at least the following:

a first directional drilling rig located at a first location to perform a first drilling job; and a second directional drilling rig located at a second location to perform a second drilling job;

collecting, at the first location, preliminary site data relating to the first drilling job to be performed by the first directional drilling rig;

collecting, at the second location, preliminary site data relating to the second drilling job to be performed by the second directional drilling rig;

transferring to the off-site system navigator the preliminary site data for at least one of the first and second drilling jobs;

preparing at least one of the first and second directional drilling rigs for the respective first and second drilling jobs;

loading data relating to at least one of the first and second drilling jobs into a navigation system operatively associated with the first and second directional drilling rigs;

commencing the first drilling job;

transferring steering patterns from the off-site system navigator to an on-site drilling operator for the first drilling job;

operating the directional drilling rig for the first drilling job in accordance with the transferred steering patterns;

sending in-process directional drilling rig operation data, drill head location-tracking data, and on-site drilling operator communications from the first drilling job to the off-site system navigator;

monitoring, at the location of the off-site system navigator, the activity of the first drilling job;

transferring (1) updated steering patterns relating to the in-process first drilling job, and (2) off-site system navigator communications, from the off-site system navigator to the on-site drilling operator of the first drilling job;

operating the directional drilling rig for the first drilling job in accordance with the transferred updated steering patterns and under the continued supervision of the off-site system navigator; while simultaneously:

commencing the second drilling job;

transferring steering patterns from the off-site system navigator to an on-site drilling operator for the second commenced drilling job;

operating the directional drilling rig for the second drilling job in accordance with the transferred steering patterns;

sending in-process directional drilling rig operation data, drill head location-tracking data, and on-site drilling operator communications from the second drilling job to the off-site system navigator;

monitoring, at the location of the off-site system navigator, the activity of the second drilling job;

transferring (1) updated steering patterns relating to the in-process second drilling job, and (2) off-site system navigator communications, from the off-site system navigator to the on-site drilling operator of the second drilling job; and operating the directional drilling rig for the second drilling job in accordance with the transferred updated steering patterns and under the continued supervision of the off-site system navigator.

2. The method of claim 1, further comprising, for at least one of the first or second commenced drilling jobs:

determining whether a survey shot should be performed;

if a survey shot should not be performed, then continuing drilling; and if a survey shot should be performed, then:

performing a first survey shot;

transferring to the off-site system navigator survey data related to the first survey shot; and receiving an approval from the off-site system navigator to perform a reverse current survey shot.

3. The method of claim 2, further comprising, if no approval from the off-site system navigator is received, then:

performing a second survey shot; and transferring to the off-site system navigator survey data relating to the second survey shot.

4. The method of claim 1, wherein said collecting preliminary site data comprises collecting preliminary site data comprising one or more selected from the group consisting of topography, land features, centerlines, and coil locations.

5. The method of claim 1, wherein said collecting preliminary site data for the first and second drilling jobs is conducted by first and second survey technicians at the first and second locations, respectively.

6. The method of claim 1, wherein said preparing is conducted by the on-site drilling operator for the commenced drilling job.

7. The method of claim 1, wherein said operating is conducted by the on-site drilling operator for the commenced drilling job.

* * * * *